US010792936B2

(12) United States Patent
Chike

(10) Patent No.: US 10,792,936 B2
(45) Date of Patent: Oct. 6, 2020

(54) COATING DEVICE, IMAGE FORMING APPARATUS, AND IMAGE FORMING SYSTEM

(71) Applicant: Kohei Chike, Kanagawa (JP)

(72) Inventor: Kohei Chike, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/264,259

(22) Filed: Jan. 31, 2019

(65) Prior Publication Data

US 2019/0263148 A1 Aug. 29, 2019

(30) Foreign Application Priority Data

Feb. 23, 2018 (JP) ..... 2018-031367

(51) Int. Cl.

| | |
|---|---|
| ***B41J 11/00*** | (2006.01) |
| ***B05C 1/02*** | (2006.01) |
| ***B41J 13/02*** | (2006.01) |

(52) U.S. Cl.

CPC ..... *B41J 11/0015* (2013.01); *B05C 1/025* (2013.01); *B41J 13/025* (2013.01)

(58) Field of Classification Search

CPC ..... B41J 2/01; B41J 11/0015; B41J 13/025; B41M 1/34; B05C 1/025

See application file for complete search history.

(56) References Cited

U.S. PATENT DOCUMENTS 5,825,397 A * 10/1998 Fujishiro ..... B41J 2/32 347/212

FOREIGN PATENT DOCUMENTS

| | | | | |
|---|---|---|---|---|
| EP | 0882665 | * | 5/1998 | ..... B65H 5/06 |
| JP | 11-165914 | | 6/1999 | |
| JP | 2010-158602 | | 7/2010 | |

* cited by examiner

*Primary Examiner* — Kristal Feggins
(74) *Attorney, Agent, or Firm* — Duft & Bornsen, PC

(57) ABSTRACT

A coating device includes a coating member, a nip forming member, a pair of conveying members, and circuitry. The nip forming member forms a coating nip together with the coating member. The pair of conveying members is opposed each other to nip and convey a recording medium to the coating nip. The circuitry is configured to cause the pair of conveying members to release nipping of the recording medium at timing when a leading end of the recording medium reaches the coating nip.

8 Claims, 7 Drawing Sheets

COATING DEVICE, IMAGE FORMING APPARATUS, AND IMAGE FORMING SYSTEM

CROSS-REFERENCE TO RELATED APPLICATIONS

This patent application is based on and claims priority pursuant to 35 U.S.C. § 119(a) to Japanese Patent Application No. 2018-031367, filed on Feb. 23, 2018, in the Japan Patent Office, the entire disclosure of which is hereby incorporated by reference herein.

BACKGROUND

Technical Field

Aspects of the present disclosure relate to a coating device, an image forming apparatus, and an image forming system.

Related Art

A coating device is known that includes a coating member, a nip forming member to form a coating nip together with the coating member, and a pair of conveying members to nip and convey a recording medium to the coating nip.

SUMMARY

In an aspect of the present disclosure, there is provided a coating device that includes a coating member, a nip forming member, a pair of conveying members, and circuitry. The nip forming member forms a coating nip together with the coating member. The pair of conveying members is opposed each other to nip and convey a recording medium to the coating nip. The circuitry is configured to cause the pair of conveying members to release nipping of the recording medium at timing when a leading end of the recording medium reaches the coating nip.

In another aspect of the present disclosure, there is provided an image forming apparatus that includes the above-described coating device to coat a recording medium with a treatment liquid and an image forming device to form an image on the recording medium coated with the treatment liquid.

In still another aspect of the present disclosure, there is provided an image forming system that includes the above-described coating device to coat a recording medium with a treatment liquid and an image forming apparatus configured to form an image on the recording medium coated with the treatment liquid.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
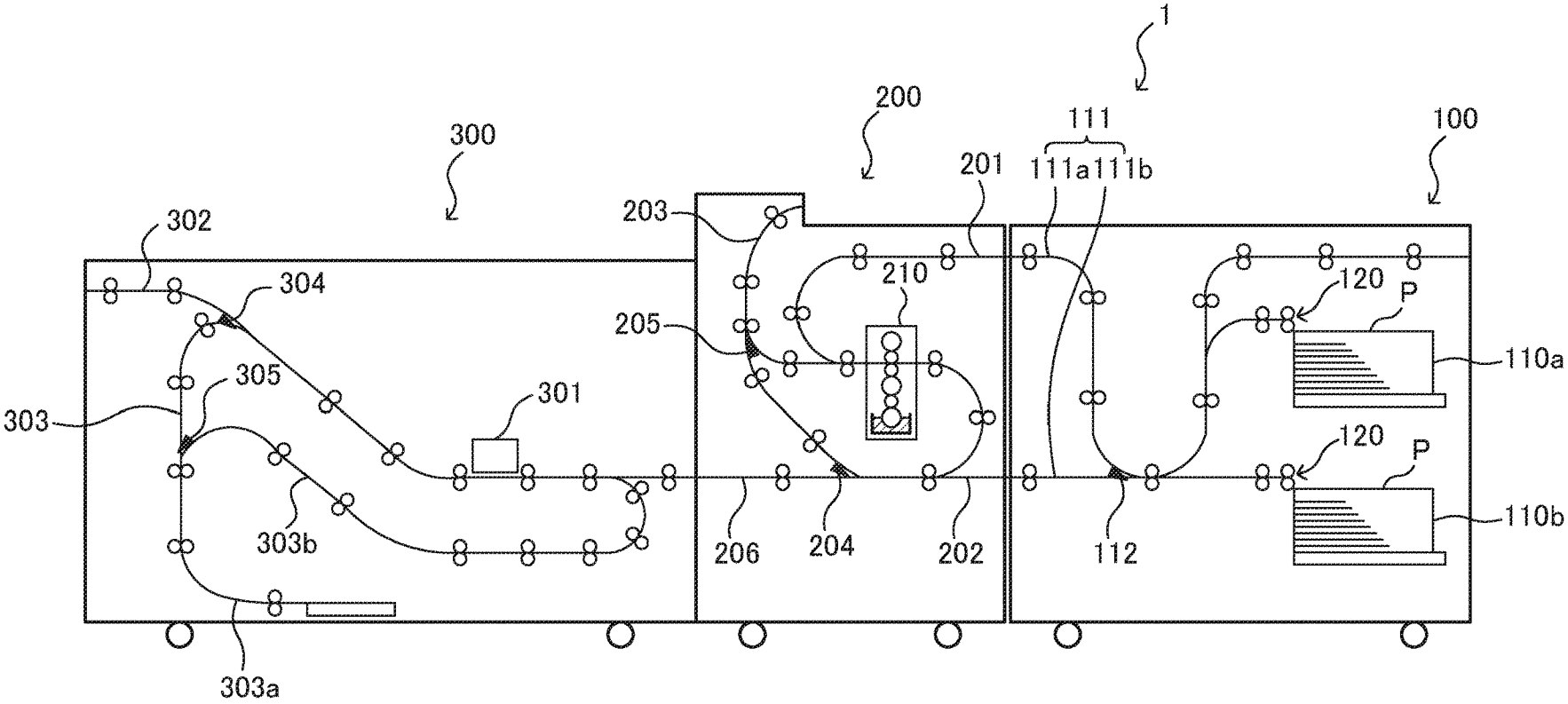
FIG. 1 is a schematic diagram illustrating a schematic configuration of an image forming system according to a first embodiment.

A more complete appreciation of the disclosure and many of the attendant advantages and features thereof can be readily obtained and understood from the following detailed description with reference to the accompanying drawings, wherein:

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of the present disclosure will be described with reference to the drawings.

First Embodiment

Overall Description

FIG. 1 is a schematic diagram illustrating a schematic configuration of an image forming system 1 according to a first embodiment.

The image forming system 1 according to the first embodiment mainly includes a sheet feeding device 100, a coating device 200, and an image forming apparatus 300. In the image forming system 1, a sheet P that is a recording medium fed by the sheet feeding device 100 is coated with a treatment liquid in the coating device 200, then, an image is formed on the sheet P with an ink that is a liquid for image formation in the image forming apparatus 300, and the sheet P is ejected.

Sheet Feeding Device

The sheet feeding device 100 includes two sheet feeding trays 110*a* and 110*b* on which a plurality of sheets P is stacked. The sheet feeding device 100 includes a plurality of pairs of sheet feed rollers 120 to separate and feed the sheets one by one from the sheet feeding trays 110*a* and 110*b*, respectively, and conveys the sheet P to the coating device 200. A feeding path 111 that feeds a sheet to the sheet feeding device 100 is branched into a first feeding path 111*a* that feeds the sheet P to a coating conveying path 201 going through the coater 210 of the coating device 200 in the middle of the path, and a second feeding path 111*b* that feeds the sheet P to a relay conveying path 202 that conveys the sheet P to the image forming apparatus without going through the coater 210 of the coating device 200. A feeding switching claw 112 that guides the sheet P to either the first feeding path 111*a* or the second feeding path 111*b* is provided in a place where the feeding path 111 is branched into the first feeding path 111*a* and the second feeding path 111*b*. The sheet P is guided by the feeding switching claw 112 and conveyed to the first feeding path 111*a* when processing of coating the sheet P with the treatment liquid is performed, and the sheet P is guided by the feeding switching claw 112 and conveyed to the second feeding path 111*b* when the sheet P is not coated with the treatment liquid.

Coating Device

The coating device 200 includes a coater 210 that coats the sheet P with the treatment liquid. Further, the coating device 200 includes the coating conveying path 201 linked with the first feeding path 111*a* of the sheet feeding device 100 and going through the coater 210, the relay conveying path 202 linked with the second feeding path 111*b* of the sheet feeding device 100 and does not go through the coater 210, a coating reversal conveying path 203 that reverses the sheet P with one side coated with the treatment liquid and conveys the sheet P to the coater again, and a coating sheet ejection path 206 that conveys the sheet P to the image forming apparatus. The conveying path is branched into the coating reversal conveying path 203 and the coating sheet ejection path 206 at a place on a downstream side in the conveying direction of a place where coating conveying path 201 and the relay conveying path 202 are merged. A coating switching claw 204 that guides the sheet P to either the coating reversal conveying path 203 or the coating sheet ejection path 206 is provided in the place where the conveying path is branched into the coating reversal conveying path 203 and the coating sheet ejection path 206.

The sheet P delivered from the first feeding path 111*a* of the sheet feeding device 100 to the coating conveying path 201 is coated with the treatment liquid on one side by the coater 210, and a liquid film layer of the treatment liquid is formed. In a case of coating one side of the sheet with the treatment liquid, the sheet P is guided to the coating sheet ejection path 206 by the coating switching claw 204 and conveyed to the image forming apparatus 300.

Meanwhile, in a case of coating both sides of the sheet P with the treatment liquid, the sheet P is guided to the coating reversal conveying path 203 by the coating switching claw 204, switched back, then guided to a resending claw 205, and conveyed to the coater 210 again. Then, the other side is coated with the treatment liquid by the coater 210, and the liquid film layers of the treatment liquid are formed on both sides, then the sheet P is guided to the coating sheet ejection path 206 by the coating switching claw 204 and conveyed to the image forming apparatus 300.

Further, the sheet P delivered from the second feeding path 111*b* of the sheet feeding device 100 to the relay conveying path 202 is guided to the coating sheet ejection path 206 by the coating switching claw 204 and conveyed to the image forming apparatus 300 without being coated with the treatment liquid.

Image Forming Apparatus

The image forming apparatus 300 includes an inkjet recorder 301. The inkjet recorder 301 discharges inks of four colors of cyan (C), magenta (M), yellow (Y), and black (K) to form an image, and includes individual liquid discharge heads for the respective inks. The configuration of the liquid discharge head is not limited as long as the head discharges a liquid, and any configuration can be adopted. A liquid discharge head that discharges a special ink such as white, gold, or silver, may be provided, or a liquid discharge head that discharges a liquid not constituting an image, such as a surface coating liquid, may be provided, as required.

Discharge operations of the liquid discharge heads of the inkjet recorder 301 are respectively controlled by drive signals according to image information. When the sheet P passes through a region facing the inkjet recorder 301, the color inks are discharged through the liquid discharge heads, and an image according to the image information is formed. Note that, in the first embodiment, the configuration of the inkjet recorder 301 is not limited as long as the inkjet recorder 301 causes a liquid to adhere to the sheet P to form an image.

Further, the image forming apparatus 300 includes a reversal path 303, and when forming images on both sides of the sheet P, the sheet P is guided to the reversal path 303 by a switching claw provided in a branching portion between the reversal path 303 and a sheet ejection path 302. The sheet guided to the reversal path 303 is switched back in a switchback path 303*a*, then guided to a resending path 303*b* by a resending claw 305, and conveyed to the inkjet recorder 301 again. Then, an image is formed on the other side of the sheet P by the inkjet recorder 301, and then the sheet P is conveyed to the sheet ejection path 302 and ejected.

Meanwhile, when forming an image on one side of the sheet P, the image is formed on the one side of the sheet by the inkjet recorder 301, and then the sheet P is conveyed to the sheet ejection path 302 and ejected.

Figure 2:
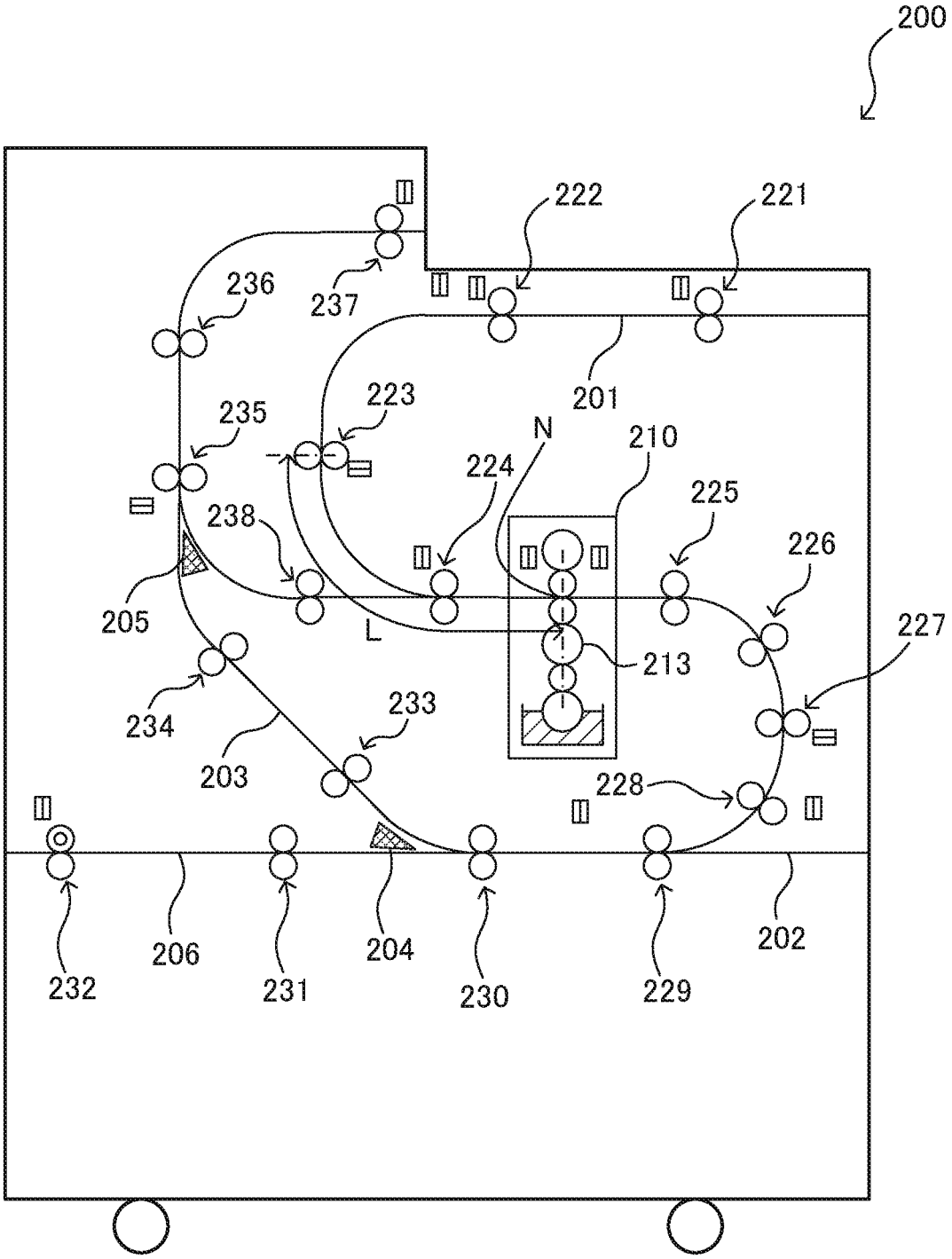
FIG. 2 is a schematic diagram illustrating a schematic configuration of a coating device.

FIG. 2 is a schematic diagram illustrating a schematic configuration of the coating device 200.

Conveying roller pairs 221 to 238 that nip and convey the sheet P are disposed in the conveying paths 201, 203, and 206 of the coating device 200.

The sheet P delivered from the first feeding path 111*a* of the sheet feeding device 100 to the coating conveying path 201 is nipped and conveyed by the conveying roller pairs 221, 222, and 223, and then nipped and conveyed to the coater 210 by the conveying roller pair 224. The sheet P coated with the treatment liquid on one side by the coater 210 is nipped and conveyed by the conveying roller pairs 225, 226, 227, 228, 229, and 230 in order. In a case of coating the both sides with the treatment liquid, when a sheet sensor arranged near the conveying roller pair 230 detects a leading end of the sheet, the coating switching claw 204 at a first posture to guide the sheet P to the coating sheet ejection path 206 is rotated clockwise in FIG. 2 by a predetermined angle to be at a second posture to guide the sheet P to the coating reversal conveying path 203. With the rotation, the sheet P is guided to the coating reversal conveying path 203 by the coating switching claw 204, and nipped and conveyed by the conveying roller pairs 233, 234, 235, 236, and 237 in order.

When arrival of the leading end in the conveying direction of the sheet at the conveying roller pair 237 is detected on the basis of a detection result of the sheet sensor provided in the coating reversal conveying path 203, the conveying roller pairs 237, 236, and 235 are reversely rotated to switch back the sheet P. Further, the resending claw 205 is rotated counterclockwise in FIG. 2 by a predetermined angle, and the sheet P is guided to the conveying roller pair 238 by the resending claw. Then, the sheet P is nipped by the conveying roller pairs 238 and 224 in order, conveyed to the coater 210, and coated with the treatment liquid on the other side in the coater 210. Thereafter, the sheet P is nipped and conveyed by the conveying roller pairs 225, 226, 227, 228, 229, 230, 231, and 232, and conveyed to the image forming apparatus 300.

Figure 3:
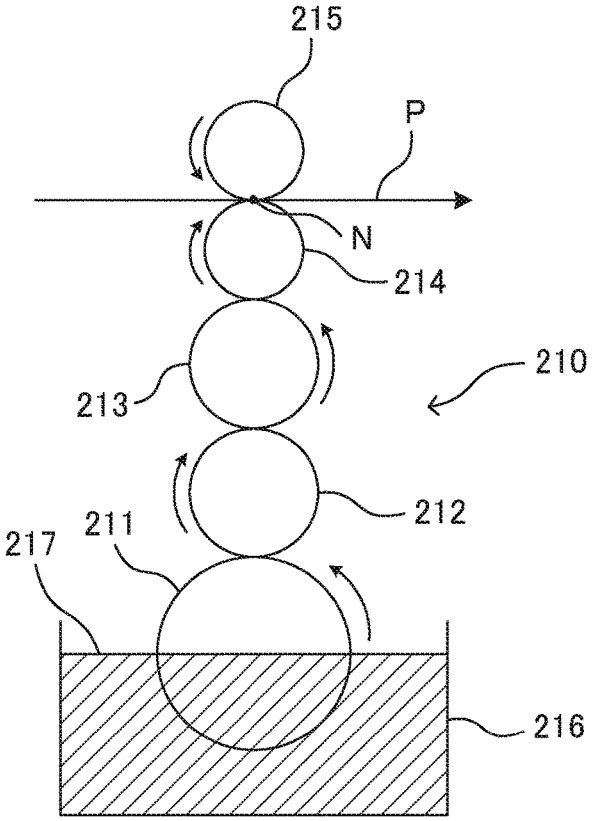
FIG. 3 is a schematic diagram illustrating a schematic configuration of a coater.

FIG. 3 is a schematic diagram illustrating a schematic configuration of the coater 210.

The coater 210 includes a supply pan 216 that stores a treatment liquid 217, a squeeze roller 211 partly immersed in the treatment liquid 217 in the supply pan 216 and scoops up the treatment liquid 217 in the supply pan 216, a first intermediate roller 212 to which the treatment liquid 217 is delivered from the squeeze roller 211, a second intermediate roller 213 to which the treatment liquid 217 is delivered from the first intermediate roller 212, a coating roller 214 to which the treatment liquid 217 is delivered from the second intermediate roller 213 and coats the sheet P with the treatment liquid 217, and a pressure roller 215 abutting on the coating roller 214 to form a coating nip.

An example of the treatment liquid 217 includes a modifying material that modifies the surface of the sheet P by being applied to the surface of the sheet P. Specifically, an example of the treatment liquid 217 includes a fixing agent (setting agent) that is uniformly applied to the sheet P in advance to allow moisture of the ink to promptly permeate into the sheet P, thicken a color component, and advance drying to prevent bleeding (feathering or the like) to increase the productivity (the number of output images per unit time).

Compositionally, a solution obtained by adding cellulose (hydroxypropyl cellulose or the like) that facilitates permeation of the moisture and a base such as talc fine powder to a surfactant (any one of or a mixture of two or more of anionic-type, cationic-type, and nonionic-type surfactants) can be used as the treatment liquid 217. Further, the treatment liquid 217 can contain fine particles.

The treatment liquid 217 scooped up by the squeeze roller 211 is controlled in film thickness by the first and second intermediate rollers 212 and 213 and delivered to the coating roller 214. Then, the sheet P conveyed to a coating nip N is coated with the treatment liquid 217 by the coating roller 214.

In the first embodiment, the coating amount of the treatment liquid 217 to the sheet P can be changed according to the type of the sheet P. For example, a pressure to be applied to the coating roller 214 by the pressure roller 215 is adjusted to change a coating nip pressure, thereby to change the coating amount of the treatment liquid 217. Further, rotation speeds of the rollers 211, 212, 213, and 214 are changed to change the coating amount. Further, an angle of the supply pan 216 may be changed to change an immersion amount of the squeeze roller 211 into the treatment liquid 217, thereby to change the coating amount.

Further, the coating roller 214 has an inverted crown shape in which the diameter becomes smaller toward the center in an axial direction. With the inverted crown shape of the coating roller 214, the sheet P having entered the coating nip N can be coated with the treatment liquid 217 while being stretched in the axial direction, whereby the treatment liquid 217 can be uniformly applied.

In the first embodiment, as illustrated in FIG. 2, a sheet conveying length L from the conveying roller pair 223 to the coating nip N is longer than a maximum length in the conveying direction of the sheet settable on the sheet feeding trays 110*a* and 110*b*, and when the leading end in the conveying direction of the sheet P reaches the coating nip N, a trailing end in the conveying direction of the sheet P passes through the conveying roller pair 223.

When the leading end of the sheet P reaches the coating nip N, and conveyed by the conveying roller pair 224 (hereinafter referred to as an inlet conveying roller pair) in front of the coater 210 in the conveying direction, and a coating nip portion of the coating roller 214 and the pressure roller 215, the following problem occurs. That is, there are some cases where a sheet conveying speed of the inlet conveying roller pair 224 and a sheet conveying speed in the coating nip N do not coincide with each other due to a manufacturing error or the like. If the sheet conveying speed of the inlet conveying roller pair 224 is faster than the sheet conveying speed in the coating nip N, the sheet P is bent between the coating nip N and the inlet conveying roller pair 224. If the sheet P is bent between the coating nip N and the inlet conveying roller pair 224 in this way, entry speed into the coating nip N changes, and coating unevenness may occur.

Further, if the sheet conveying speed of the inlet conveying roller pair 224 is slower than the sheet conveying speed in the coating nip N, the sheet P is stretched between the inlet conveying roller pair 224 and the coating nip N. If the sheet P is stretched between the inlet conveying roller pair 224 and the coating nip N, the sheet P slightly undulates in a width direction between the inlet conveying roller pair 224 and the coating nip N in some cases. In particular, in the first embodiment, the sheet P is conveyed while being stretched in the width direction by the coating roller 214 with the inverted crown shape. Therefore, the slight undulation is more likely to occur in the sheet P between the inlet conveying roller pair 224 and the coating nip N. Since the nip pressure of the coating nip N is higher than the nip pressure of the conveying roller pair 224, the slight undulation is crushed at the entry into the coating nip N, and longitudinal wrinkles extending in the conveying direction may occur in the sheet P.

Therefore, in the first embodiment, the nipping of the sheet P by the inlet conveying roller pair 224 is released to stop the sheet conveyance by the inlet conveying roller pair 224 at timing when the leading end in the conveying direction of the sheet P reaches the coating nip N.

Figure 4:
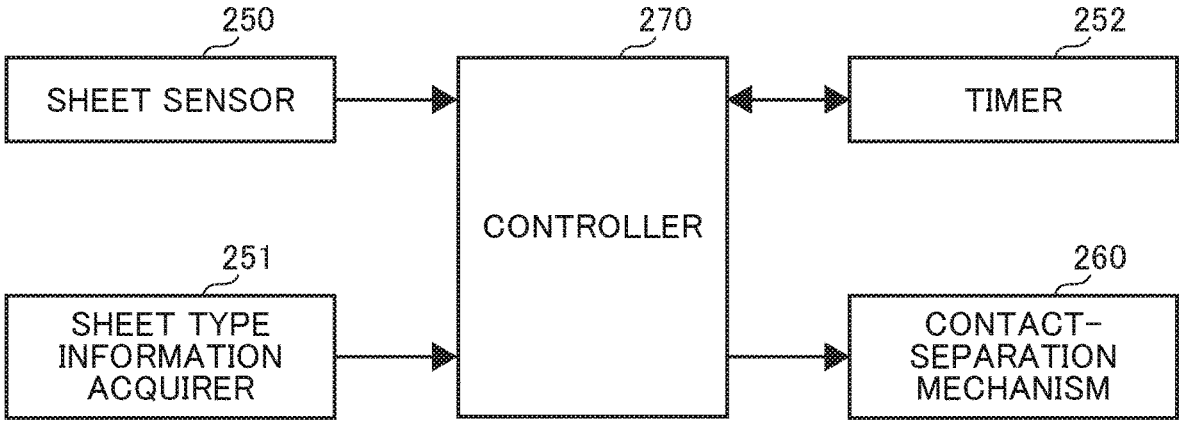
FIG. 4 is a control block diagram regarding control of releasing nipping of a sheet by an inlet conveying roller pair.

FIG. 4 is a control block diagram regarding control of releasing nipping of the sheet P by the inlet conveying roller pair 224.

As illustrated in FIG. 4, a contact-separation mechanism 260 that separates one conveying roller of the inlet conveying roller pair 224 from the other conveying roller is coupled to a controller 270. Further, a sheet sensor 250 arranged between the inlet conveying roller pair 224 and the coating nip N, a timer 252 that measures time, a sheet type information acquirer 251 that acquires the type of the conveyed sheet, and the like are coupled to the controller 270.

The sheet type information acquirer 251 can serve as an operation display for a user to input various types of information, for example. The sheet type information acquirer 251 can acquire sheet type information of the sheet set on the sheet feeding tray by an operation of the user on the operation display. Examples of the sheet type information include glossy paper, plain paper, recycled paper, thin paper, and thick paper. Further, a detector to detect the sheet type may be provided in the first feeding path of the sheet feeding device 100 to acquire the sheet type information. The controller 270 adjusts timing to drive the contact-separation mechanism 260 on the basis of the sheet type information acquired from the sheet type information acquirer 251.

Figure 5B:
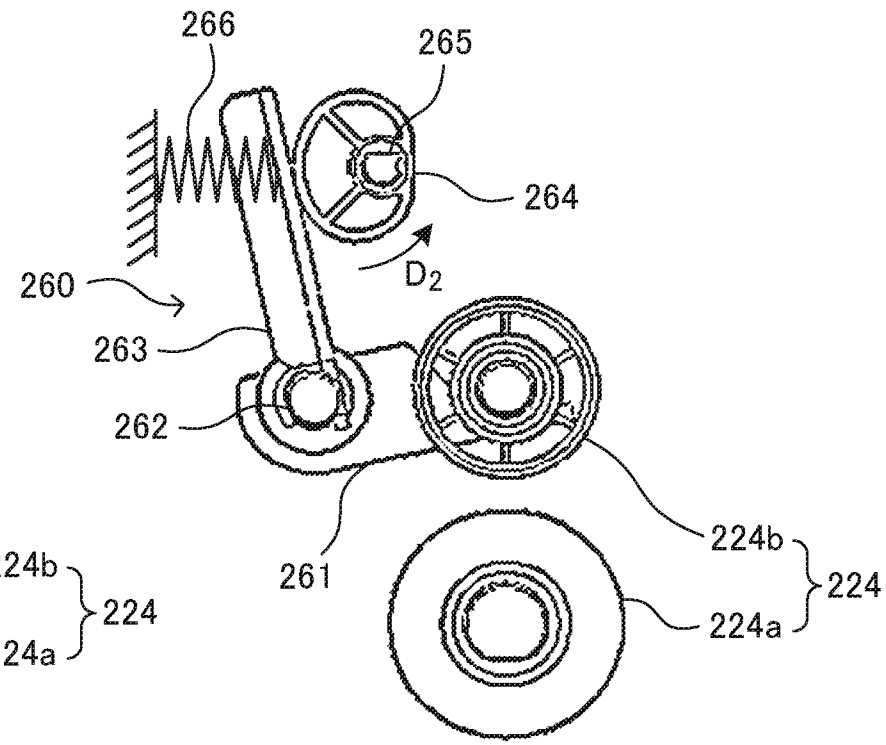
FIGS. 5A and 5B are schematic diagrams illustrating a schematic configuration of a contact-separation mechanism.
Figure 5A:
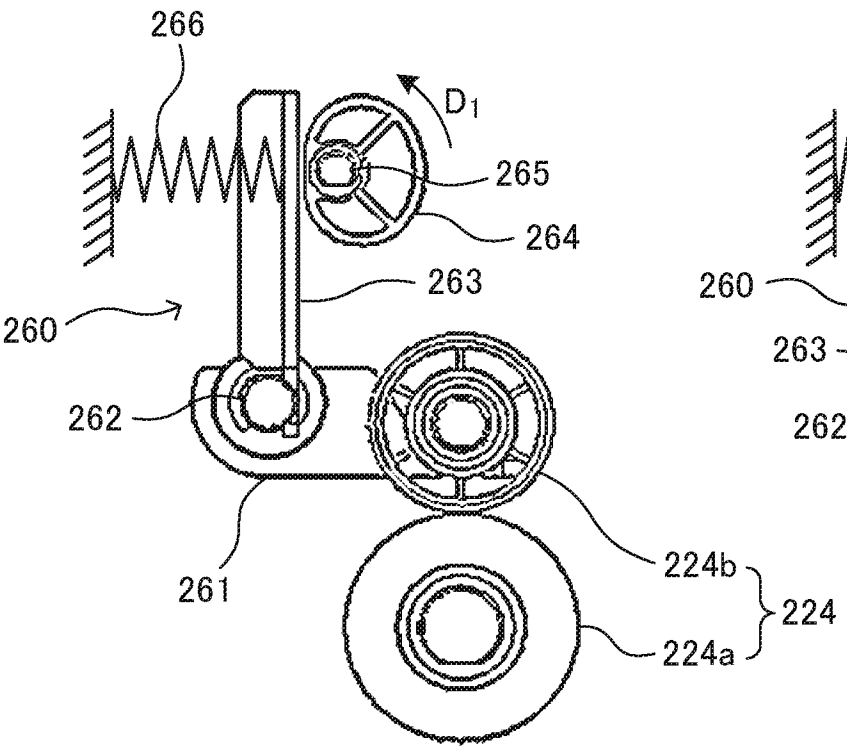

FIGS. 5A and 5B are schematic diagrams illustrating a schematic configuration of the contact-separation mechanism 260.

FIG. 5A illustrates a state in which a driven roller 224*b* is located at a contact position where the driven roller 224*b* and a drive roller 224*a* of the inlet conveying roller pair 224 come into contact with each other. FIG. 5B illustrates a state in which the driven roller 224*b* is located at a separated position where the driven roller 224*b* and the drive roller 224*a* of the inlet conveying roller pair 224 are separated from each other.

The contact-separation mechanism 260 includes, at one end, an armarm 261 that rotatably supports the driven roller 224*b*. The arm 261 extends upstream in the sheet conveying direction, and a shaft 262 that integrally rotates with the arm 261 is attached to the other end. One end of a cam receiving member 263 extending in a direction orthogonal to an extending direction of the arm 261 is attached to the shaft 262 so as to integrally rotate with the shaft 262. Further, the contact-separation mechanism 260 includes a cam 264 attached to integrally rotate with a drive shaft 265 that receives a driving force from a stepping motor. The cam 264 abuts on a vicinity of the other end of the cam receiving member 263 from a downstream side in the sheet direction of the cam receiving member 263. Further, the contact-separation mechanism 260 is provided with a spring 266 that urges the vicinity of the other end of the cam receiving member 263 toward the cam 264.

As illustrated in FIG. 5A, when the driven roller 224*b* is in the contact position, the cam receiving member 263 abuts on a bottom dead center of the cam 264. In a case of separating the driven roller 224*b* from the drive roller 224*a*, the cam 264 is rotated in the arrow $D_1$ direction in FIG. 5A. Then, the cam receiving member 263 is pushed by the cam 264 and rotates counterclockwise in FIG. 5A together with the shaft 262 with the shaft 262 as a fulcrum. The arm 261 rotates counterclockwise together with the shaft 262 as the shaft 262 rotates counterclockwise, and the driven roller 224*b* attached to the one end of the arm 261 is separated from the drive roller 224*a*. Then, the cam 264 approximately half rotates, and when a top dead center of the cam 264 abuts on the cam receiving member 263 as illustrated in FIG. 5B, the rotation of the cam 264 is stopped.

Further, in a case of moving the driven roller 224*b* from the separated position illustrated in FIG. 5B to the contact position, the cam 264 is approximately half rotated in the arrow $D_2$ direction in FIG. 5B, and the rotation of the cam 264 is stopped when the bottom dead center of the cam 264 abuts on the cam receiving member 263.

Figure 6:
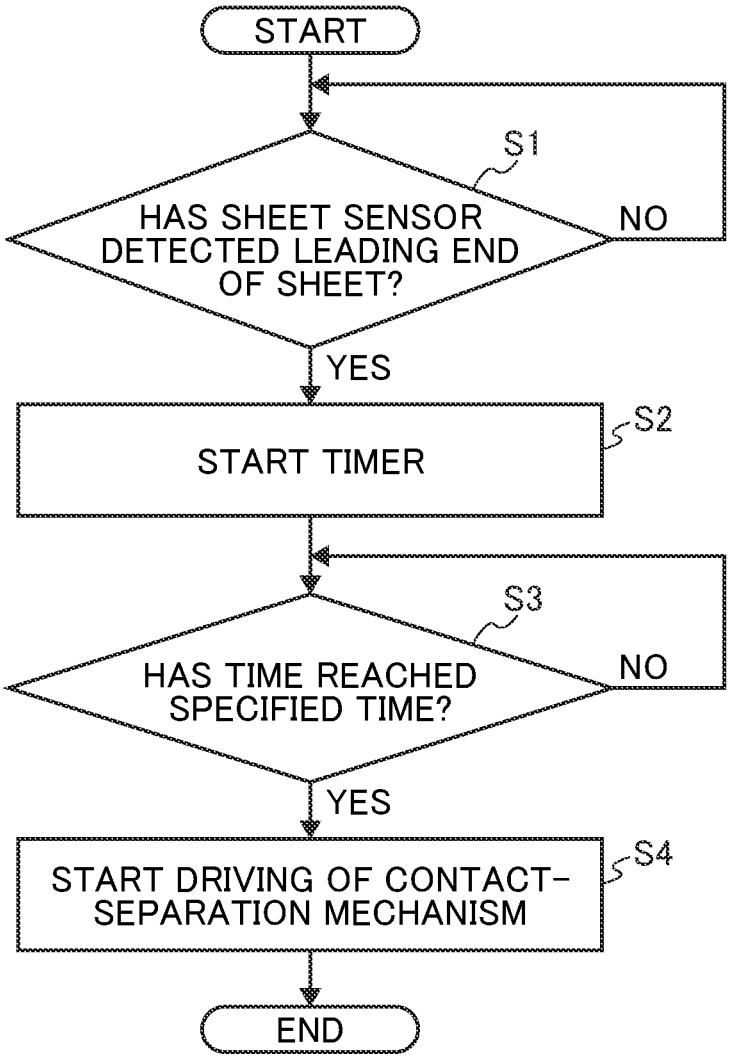
FIG. 6 is a control flowchart of releasing nipping of the sheet by the inlet conveying roller pair.
Figure 7A:
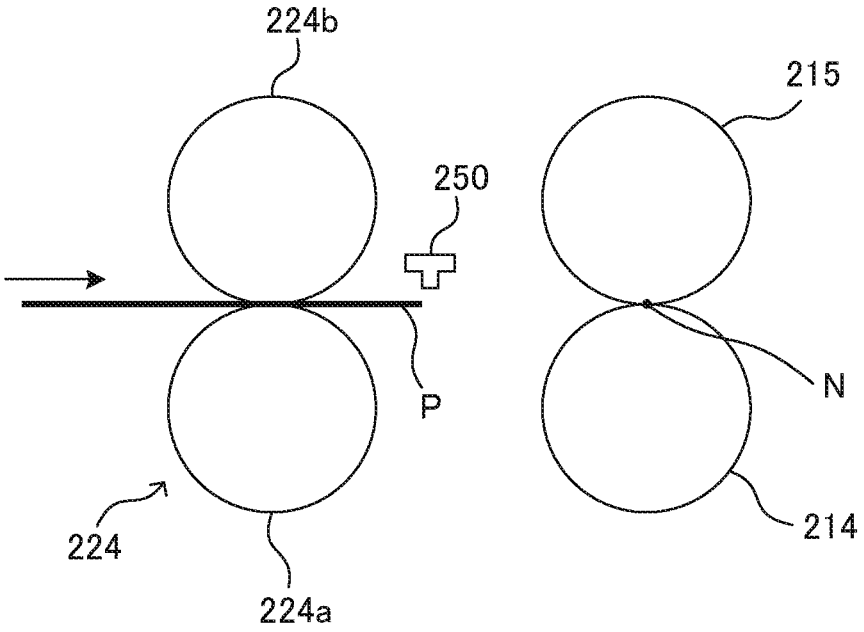
FIGS. 7A and 7B are diagrams for describing releasing of the nipping of the sheet by the inlet conveying roller pair.
Figure 7B:
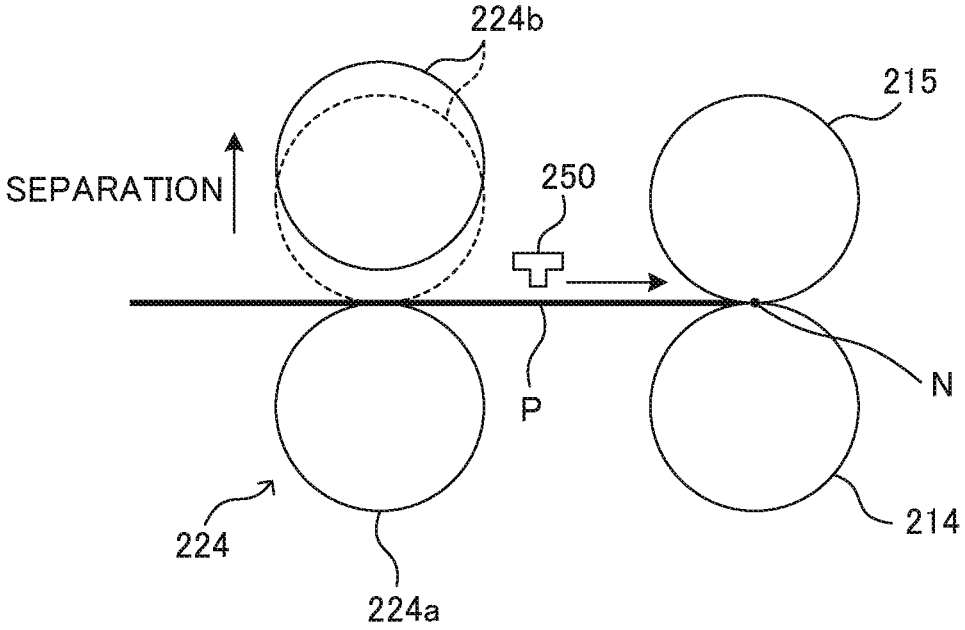

FIG. 6 is a control flowchart of releasing nipping of the sheet P by the inlet conveying roller pair 224, and FIGS. 7A and 7B are diagrams for describing the releasing nipping of the sheet P by the inlet conveying roller pair 224.

As illustrated in FIG. 6, when the sheet sensor 250 arranged between the inlet conveying roller pair 224 and the coating nip N detects the leading end of the sheet P, as illustrated in FIG. 7A (Yes in S1), the controller 270 starts the timer 252 and starts measurement of time (S2).

Next, when the time of the timer 252 reaches a specified time t (Yes in S3), the controller 270 drives the stepping motor of the contact-separation mechanism 260 and starts to move the driven roller 224*b* from the contact position to the separated position (S4). Then, the driven roller 224*b* reaches the separated position and the nipping of the sheet P by the inlet conveying roller pair 224 is released, as illustrated in FIG. 7B, at the timing when the leading end of the sheet P reaches the coating nip N.

With the operation, the nipping and conveyance of the sheet P by the inlet conveying roller pair 224 is released at the timing when the leading end in the conveying direction of the sheet P reaches the coating nip N, and the sheet P is nipped and conveyed by the pressure roller 215 and the coating roller 214. Therefore, after the leading end in the conveying direction of the sheet P reaches the coating nip N, the sheet P is nipped and conveyed by the pressure roller 215 and the coating roller 214 alone. With the operation, the sheet P can be prevented from being bent or stretched between the inlet conveying roller pair 224 and the coating nip N. As a result, occurrence of the coating unevenness and the longitudinal wrinkles in the sheet P can be suppressed.

Note that the timing when the leading end of the sheet P reaches the coating nip N is predetermined timing when the sheet P receives a conveying force from the coating roller 214 or the pressure roller 215, and the conveying force does not reach a bending amount or a stretching amount of the sheet P, which causes the coating unevenness and the longitudinal wrinkles. Therefore, the nipping of the sheet P by the inlet conveying roller pair 224 may just be released at the predetermined timing from the state where the leading end of the sheet P comes into contact with the coating roller 214 or the pressure roller 215 to before the conveying force applied to the sheet P reaching the bending amount or the stretching amount, which causes the coating unevenness and the longitudinal wrinkles.

Note that the releasing of nipping of the sheet P by the inlet conveying roller pair 224 refers to a state in which the sheet P does not receive the conveying force from the inlet conveying roller pair 224. Therefore, even if the sheet P is in contact with both of the conveying rollers of the inlet conveying roller pair 224, the nipping of the sheet P is released if the sheet P does not receive the conveying force from the inlet conveying roller pair 224. Therefore, the driven roller 224*b* does not need to reach the separated position at the timing when the leading end of the sheet P reaches the coating nip N, and may be in the middle of movement to the separated position.

Further, the specified time t to start driving of the contact-separation mechanism 260 is favorably changed depending on the type of the sheet P. A frictional force between the sheet P and the inlet conveying roller pair 224 differs depending on the type of the sheet P, and there are some cases where the actual sheet conveying speed differs even when the rotation speed of the inlet conveying roller pair 224 is the same. As a result, in a case of the sheet P with a smooth surface such as glossy paper, the sheet conveying speed becomes slower than a specified sheet conveying speed, and there is a possibility that the nipping of the sheet P by the inlet conveying roller pair 224 is released before the leading end of the sheet P reaches the coating nip N. Meanwhile, in a case of the sheet P with a rough surface, the sheet conveying speed becomes faster than the specified sheet conveying speed, and there is a possibility that the nipping of the sheet P by the inlet conveying roller pair 224 is released after the leading end of the sheet P reaches the coating nip N.

Therefore, the specified time t to start driving of the contact-separation mechanism 260 is changed according to the type of the sheet P, whereby the nipping of the sheet P by the inlet conveying roller pair 224 can be reliably released at the timing when the leading end of the sheet P reaches the coating nip N.

Further, in a case of changing the coating nip pressure to adjust the coating amount, the nip width is changed with the change of the coating nip pressure, and the timing when the leading end of the sheet P reaches the coating nip N becomes different. Further, in a case of changing the rotation speeds of the rollers 211, 212, 213, and 214 of the coater 210, the sheet conveying speed of the entire device is also changed, so the timing when the leading end of the sheet P reaches the coating nip N becomes different.

Therefore, change of the specified time t according to the coating amount is favorable in the case of changing the coating nip pressure to adjust the coating amount or the case of changing the rotation speeds of the rollers 211, 212, 213, and 214 of the coater 210 to change the coating amount. As a result, the nipping of the sheet P by the inlet conveying roller pair 224 can be reliably released at the timing when the leading end of the sheet P reaches the coating nip N.

Note that the sheet P that has left the coating nip N is conveyed by the conveying roller pair 225 adjacent to the coating nip N on the downstream side in the conveying direction and the coating nip N. Therefore, if the conveying speeds are different between the conveying roller pair 225 and the coating nip N, the sheet P is bent or stretched between the conveying roller pair 225 and the coating nip N. However, even if the sheet P is bent between the coating nip N and the conveying roller pair 225, and the entry speed into the conveying roller pair 225 is not stabilized, the disadvantage such as the coating unevenness does not arise. Further, the conveying rollers are arranged such that a plurality of rollers with a short axial length is arranged at specified intervals, unlike the coating rollers and the pressure rollers. Further, the nip pressure of the conveying roller pair 225 is lower than the coating nip pressure. Therefore, even if the sheet P is stretched between the coating nip N and the conveying roller pair 225, and the slight undulation occurs in the sheet P, the slight undulation is not crushed by the nip of the conveying roller pair 225 and the longitudinal wrinkles do not occur in the sheet P.

Second Embodiment

Figure 8:
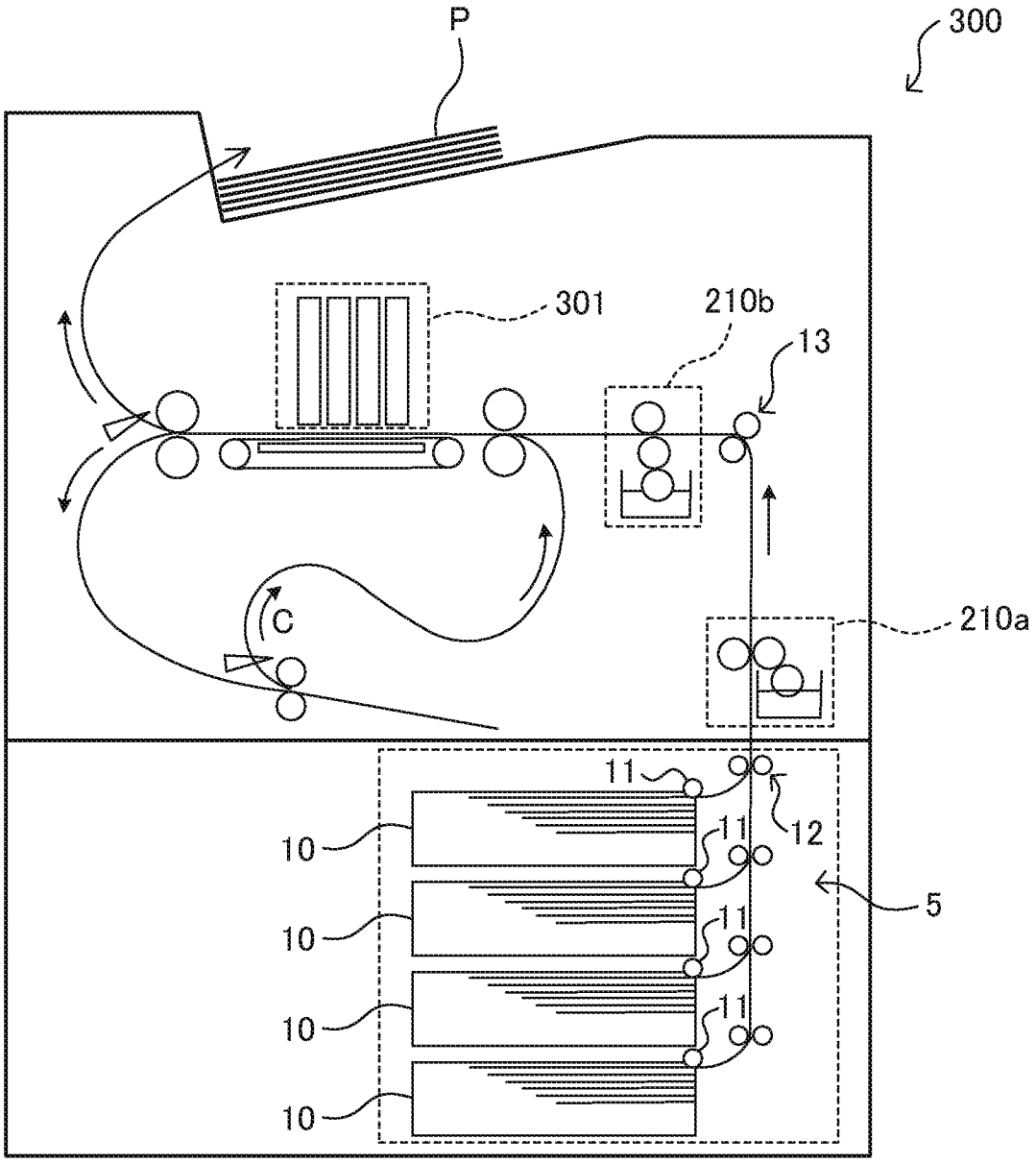
FIG. 8 is a schematic diagram illustrating a schematic configuration of an image forming apparatus according to a second embodiment.

FIG. 8 is a schematic diagram illustrating a schematic configuration of an image forming apparatus 300 according to a second embodiment.

As illustrated in FIG. 8, the image forming apparatus 300 includes a sheet feeder 5 including a plurality of sheet feeding trays 10, a first coater 210*a* that coats a first side of a sheet with a treatment liquid, and a second coater 210*b* that coats a second side of the sheet with the treatment liquid. Also in this image forming apparatus, one conveying roller of a conveying roller pair 12 that conveys the sheet to a coating nip of the first coater 210*a* and one conveying roller of a conveying roller pair 13 that conveys the sheet to a coating nip of the second coater 210*b* are separated from the other conveying rollers at timing when the sheet reaches the coating nips to release nipping and conveyance. With the operation, occurrence of coating unevenness of the treatment liquid on the first and second sides of the sheet can be suppressed, and occurrence of longitudinal wrinkles in the sheet P can be suppressed.

The above description is merely examples, and a specific effect is exerted in each of the following aspects.

Aspect 1

In the coating device 200 including a coating member such as the coating roller 214, a nip forming member such as the pressure roller 215 forming the coating nip N together with the coating member, and a pair of conveying members such as the inlet conveying roller pair 224 to nip and convey a recording medium to the coating nip, in which nipping of the recording medium by the pair of conveying members is released at timing when a leading end of the recording medium reaches the coating nip N.

The conveying speed of the recording medium by the pair of conveying members and the conveying speed of the recording medium at the coating nip may be different from each other due to a manufacturing error or the like. If the conveying speed of the recording medium by the pair of conveying members is faster than the conveying speed of the recording medium at the coating nip, the recording medium is bent between the pair of conveying members and the coating nip. If the recording medium is bent between the pair of conveying members and the coating nip as described above, the entry speed into the coating nip is not stabilized, and the coating unevenness may occur.

Further, if the conveying speed of the recording medium by the pair of conveying members is slower than the conveying speed of the recording medium at the coating nip, the recording medium is stretched between the pair of conveying members and the coating nip. If the recording medium is stretched between the conveying members and the coating nip, the sheet slightly undulates in the width direction between the conveying members and the coating nip in some cases. If the recording medium enters the coating nip in the state of slight undulation, the slight undulation is crushed by the nip pressure of the coating nip, and longitudinal wrinkles extending in the conveying direction may occur in the recording medium.

Therefore, in aspect 1, the nipping of the recording medium by the pair of conveying members is released to stop conveyance by the pair of conveying members at the timing when the leading end in the conveying direction of the recording medium reaches the coating nip. With the operation, the recording medium can be prevented from being bent or stretched between the pair of conveying members and the coating nip. As a result, occurrence of the coating unevenness and occurrence of the wrinkles of the recording medium can be suppressed.

Aspect 2

In aspect 1, the coating member such as the coating roller 214 is an inverted crown shaped roller member having a central portion with a smaller diameter than both end portions.

According to this configuration, the treatment liquid can be applied in the state where the recording medium is stretched in the width direction, as described in the embodiment, and the coating unevenness can be suppressed. Meanwhile, with the inverted crown shape of the coating member, the longitudinal wrinkles are more likely to occur when the conveying speed of the pair of conveying members is slower than the conveying speed at the coating nip. However, in this aspect, the nipping of the recording medium by the pair of conveying members is released at the timing when the leading end in the conveying direction of the recording medium reaches the coating nip N. Therefore, the occurrence of the longitudinal wrinkles can be favorably suppressed.

Aspect 3

In aspect 1 or 2, a detector such as the sheet sensor 250 arranged between the pair of conveying members such as the inlet conveying roller pair 224 and the coating nip N and to detect the recording medium such as the sheet P, a mover such as the contact-separation mechanism 260 to move either one of the pair of conveying members between a nipping position at which the pair of conveying members nips the recording medium and a separated position at which the one of the pair of conveying members is separated from the recording medium, and a circuitry such as the controller 270 to control the mover on the basis of a detection result of the detector are included.

According to this configuration, as described in the embodiment, either one of the pair of conveying members is separated from the other conveying member to release the nipping of the recording medium at the timing when the leading end in the conveying direction of the recording medium reaches the coating nip N.

Aspect 4

In aspect 3, the circuitry such as the controller 270 changes a time from when the detector such as the sheet sensor 250 detects the recording medium to when the circuitry starts driving of the mover such as the contact-separation mechanism 260 on the basis of the type of the recording medium or the coating amount of the treatment liquid to the recording medium. According to this configuration, as described in the embodiment, even if the rotation speed of the pair of conveying members is the same, the conveying speed of the recording medium differs depending on the type of the recording medium, and the time from when the detector such as the sheet sensor 250 detects the recording medium to when the conveyed leading end of the recording medium reaches the coating nip differs.

Further, in the case where the coating amount of the treatment liquid to the recording medium is changed by changing the nip pressure of the coating nip, the coating nip width varies depending on the coating amount of the treatment liquid to the recording medium. Therefore, the time from when the detector such as the sheet sensor 250 detects the recording medium to when the conveyed leading end of the recording medium reaches the coating nip differs.

Therefore, the time from when the detector such as the sheet sensor 250 detects the recording medium to when the circuitry starts driving of the mover such as the contact-separation mechanism 260 is changed on the basis of the type of the recording medium or the coating amount of the treatment liquid to the recording medium, whereby the nipping of the recording medium can be released at the timing when the conveyed leading end of the recording medium reaches the coating nip.

Aspect 5

In aspect 4, the nip pressure of the coating nip N is changed to change the coating amount of the treatment liquid to the recording medium.

According to this configuration, as described in the embodiment, when the coating amount of the treatment liquid to the recording medium is changed, the nip width of the coating nip N varies, and the time from when the detector such as the sheet sensor 250 detects the recording medium to when the conveyed leading end of the recording medium reaches the coating nip differs.

Therefore, the time from when the detector such as the sheet sensor 250 detects the recording medium to when the circuitry starts driving of the mover such as the contact-separation mechanism 260 is changed on the basis of the type of the recording medium or the coating amount of the treatment liquid to the recording medium, whereby the nipping of the recording medium can be released at the timing when the conveyed leading end of the recording medium reaches the coating nip.

Aspect 6

In any of aspects 3 to 5, the mover such as the contact-separation mechanism 260 includes the arm 261 holding either one of the pair of conveying members and having a fulcrum of rotation at a position different from a holding position of the either one of the pair of conveying members, and a driver (including the cam receiving member 263, the cam 264, the spring 266, the drive motor, and the like in the first embodiment) to rotate the arm.

According to this configuration, as described in the embodiment, one of the pair of conveying members can be brought into contact with or separated from the other conveying member.

Aspect 7

In the image forming apparatus 300 including a coater (the first coater 210*a* and the second coater 210*b*) to coat the recording medium such as the sheet P with the treatment liquid, and an image forming device such as the inkjet recorder 301 to form an image on the recording medium coated with the treatment liquid, in which the coating device according to any one of aspects 1 to 6 is used as the coater.

According to this configuration, as described in the second embodiment, the coating unevenness can be suppressed and the occurrence of the longitudinal wrinkles in the recording medium can be suppressed.

Aspect 8

In the image forming system 1 including the coating device 200 to coat the recording medium such as the sheet P with the treatment liquid and the image forming apparatus 300 to form an image on the recording medium coated with the treatment liquid, in which the coating device according to any one of aspects 1 to 6 is used as the coating device.

According to this configuration, as described in the embodiment, the coating unevenness can be suppressed and the occurrence of the longitudinal wrinkles in the recording medium can be suppressed.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A coating device comprising:

a coating member;

a nip forming member forming a coating nip together with the coating member;

a pair of conveying members opposed each other to nip and convey a recording medium to the coating nip; and circuitry configured to cause the pair of conveying members to release nipping of the recording medium at timing when a leading end of the recording medium reaches the coating nip.

2. The coating device according to claim 1, wherein the coating member is an inverted crown shaped roller having a central portion with a smaller diameter than both end portions in an axial direction of the inverted crown shaped roller.

3. The coating device according to claim 1, further comprising:

a detector disposed between the pair of conveying members and the coating nip and configured to detect the recording medium; and a mover configured to move one of the pair of conveying members between a nipping position at which the pair of conveying members nips the recording medium and a separated position at which the one of the pair of conveying members is separated from the recording medium, wherein the circuitry is configured to control the mover on basis of a detection result of the detector.

4. The coating device according to claim 3, wherein the circuitry is configured to change a time from when the detector detects the recording medium to when the circuitry starts driving of the mover on basis of a type of the recording medium or a coating amount of a liquid to the recording medium.

5. The coating device according to claim 4, wherein the circuitry is configured to change a nip pressure of the coating nip to change the coating amount.

6. The coating device according to claim 3, wherein the mover includes:

an arm holding the one of the pair of conveying members at a holding position and having a fulcrum of rotation at a position different from the holding position; and a driver configured to rotate the arm.

7. An image forming apparatus comprising:

the coating device according to claim 1 to coat a recording medium with a treatment liquid; and an image forming device to form an image on the recording medium coated with the treatment liquid.

8. An image forming system comprising:

the coating device according to claim 1 to coat a recording medium with a treatment liquid; and an image forming apparatus configured to form an image on the recording medium coated with the treatment liquid.

* * * * *